US007348118B2

(12) United States Patent
Lee et al.

(10) Patent No.: US 7,348,118 B2
(45) Date of Patent: Mar. 25, 2008

(54) NON-MAGNETIC MONOCOMPONENT TONER HAVING EXCELLENT DEVELOPING PROPERTY AT LOW TEMPERATURE CONDITION

(75) Inventors: Won-Sup Lee, Daejeon (KR); Chang-Soon Lee, Daejeon (KR); In-Hee Lim, Seoul (KR)

(73) Assignee: LG Chem, Ltd., Seoul (KR)

( * ) Notice: Subject to any disclaimer, the term of this patent is extended or adjusted under 35 U.S.C. 154(b) by 409 days.

(21) Appl. No.: 10/527,155

(22) PCT Filed: Dec. 16, 2004

(86) PCT No.: PCT/KR2004/003321

§ 371 (c)(1),
(2), (4) Date: Mar. 9, 2005

(87) PCT Pub. No.: WO2005/059656

PCT Pub. Date: Jun. 30, 2005

(65) Prior Publication Data

US 2005/0271960 A1 Dec. 8, 2005

(30) Foreign Application Priority Data

Dec. 19, 2003 (KR) ..... 10-2003-0093817
Dec. 15, 2004 (KR) ..... 10-2004-0106175

(51) Int. Cl.
*G03G 9/08* (2006.01)

(52) U.S. Cl. ..... 430/108.6; 430/108.1; 430/137.2

(58) Field of Classification Search ..... 430/108.6, 430/108.1, 137.2
See application file for complete search history.

(56) References Cited

U.S. PATENT DOCUMENTS 5,185,229 A 2/1993 Sato et al.
5,348,829 A 9/1994 Uchiyama et al.
5,905,010 A 5/1999 Nakamura et al.
5,915,150 A * 6/1999 Kukimoto et al. ..... 399/149
6,203,955 B1 3/2001 Mochizuki
2002/0098434 A1 7/2002 Anno et al.

FOREIGN PATENT DOCUMENTS

EP 0 860 746 A2 8/1998
EP 0 860 746 A3 11/1999
KR 1020020034064 8/2002
WO WO 03/087951 A1 10/2003

OTHER PUBLICATIONS

International Search Report from Korean Patent Office.
Written Opinion of the International Searching Authority.

* cited by examiner

*Primary Examiner*—Mark A. Chapman
(74) *Attorney, Agent, or Firm*—McKenna Long & Aldridge LLP

(57) ABSTRACT

The present invention relates to a non-magnetic mono-component toner composition and a preparation method thereof. Disclosed is a non-magnetic mono-component toner composition prepared by coating a spherical organic fine particle having a weight-average molecular weight ($M_w$) of 250,000-1,600,000 and an average particle size of 50-500 nm, a hydrophobic silica, and a metal oxide fine particle on a toner mother particle. The non-magnetic mono-component toner composition of the present invention ensures smooth toner supply because of good fluidity, reduces PCR contamination and deterioration of image quality, enables uniform toner layer formation on the development roller, prevents blocking at the blade of the development roller, and solves the low temperature double image problemin the non-imaging region at a low temperature. Therefore, it can be useful for an image printing apparatus adopting the non-magnetic mono-component development system in which the developing roller contacts the photoreceptor.

18 Claims, No Drawings

NON-MAGNETIC MONOCOMPONENT TONER HAVING EXCELLENT DEVELOPING PROPERTY AT LOW TEMPERATURE CONDITION

CROSS-REFERENCE TO RELATED APPLICATION

This application claims the benefit of Korean Patent Application Nos. 10-2003-0093817 and 10-2004-0106175, filed Dec. 19, 2003 and Dec. 15, 2004 respectively in Korea, which are hereby incorporated by reference in their entirety.

BACKGROUND OF THE INVENTION (a) Field of the Invention

The present invention relates to a non-magnetic mono-component toner composition, used for non-magnetic mono-component developing system in which a developing roller and a photoreceptor contact each other, and a preparation method thereof.

(b) Description of the Related Art

In general, dry developing method in electrophotography can be largely classified into dual-component developing system using a dual-component developer comprising a toner and a carrier, and mono-component developing system using a mono-component developer comprising a toner only. Between the two, the mono-component developing system is advantageous in compactness, cost, and maintenance. The mono-component developing system is further classified depending on whether a magnetic toner or a non-magnetic toner is used. The system of using non-magnetic toner is advantageous in that color printing is possible. Accordingly, copiers and printers employing non-magnetic mono-component developing system are coming into wide use, and the printing speed is improving significantly.

Differing from the dual-component toner using a dual-component developer comprising carrier particles that help the transfer of toner particles or the magnetic toner using magnetic force to transfer toner particles, the fluidity of toner particles themselves greatly affects the transfer characteristics in the non-magnetic mono-component toner. That is to say, fluidity is the most important physical property of a non-magnetic mono-component toner. It greatly affects copying and printing image quality, image density, fogging (image contamination by toner transfer from the non-imaging region), cleaning characteristics of the toner, etc. If the toner particles have insufficient fluidity, stripped line contamination arises in the copied or printed image. This is because the non-magnetic mono-component toner stagnates at the region between the developing roller and the sub-roller for providing the toner to the developing roller, and thus it is not smoothly transferred to the surface of the developing roller.

In addition to fluidity and toner blocking, the toner characteristic related with charging mechanism of the photoreceptor is also an important property. In general, charging mechanism of copiers or printers is classified into the type in which the charger does not contact the photoreceptor (e.g., corona charging mechanism), and the method in which the charger contacts the photoreceptor (e.g., roller charging mechanism). Of the two, the roller charging method is widely adopted because it generates less ozone. In the roller charging method, the primary charge roller (PCR) is contacted with the photoreceptor to charge the surface of the photoreceptor. If there is contamination on the surface of the PCR because of toner attached to it, image contamination such as fogging and uneven image takes place. In particular, because the fluidity decreases further at a low temperature, the toner tends to attach strongly to the surface of the PCR, thereby impairing charging characteristics and transfer efficiency.

Easy removing fine particles such as silica have been included in the toner particles in order to improve fluidity and charging ability of the toner at a low temperature. The fine particles reduce adhesion force of the toner to the drum, and thereby improve the transfer efficiency. To attain good transfer efficiency, many fine particles have to be coated on the toner surface, but this may cause lowering of charging ability of the toner, adhesion of the fine particles to the carrier causing an electrostatic latent image, etc., filming, fixing problems, and so forth. In particular, because silica particles are greatly environment-dependent, uneven image-uneven image may occur at a low temperature and humidity, and contamination at the non-imaging region may occur at high temperature and humidity.

To solve the environment-dependency of toner charging, inorganic fine particles such as titanium oxide, which have lower electrical resistance and better charge exchangeability compared with the silica particles, have been added. However, charge distribution of the toner may change easily in this case.

To solve this problem, a method of increasing electrical resistance by treating the surface of the inorganic fine particles with a silane couping agent, etc., has been proposed. In this case, the fine particles have a stronger coagulation property, so that dispersibility on the toner surface is reduced and the charge exchangeability is decreased, which may cause a decrease of toner fluidity or blocking by free coagulated particles.

Also, differing from the magnetic mono-component toner, in which the toner is easily transferred to the developing roller by magnetic attraction, the thickness of the toner layer is controlled by pressing a blade made of metal or rubber on the developing roller and the toner is charged, when using the non-magnetic mono-component toner. Accordingly, because a pressure is applied on the non-magnetic mono-component toner, the toner may block the developing roller and the blade if used for a long time, which may make the thickness of the toner layer on the developing roller and the degree of charging non-uniform, thereby causing fogging or shading.

In order to prevent toner blocking, the glass transition temperature ($T_g$) and molecular weight of the binder resin comprised in toner mother particles have been increased. However, this inevitably worsens the fusing property of the toner and the flatness of fused images, and makes the image non-uniform. Although this method is advantageous in preventing toner blocking on the developing roller at a high temperature, the low temperature double image problem at the non-imaging region because of failure to remove the toner remaining on the photoreceptor surface, arises at a low temperature, especially in the non-magnetic mono-component development system in which the cleaning process is omitted.

Thus, with regard to non-magnetic mono-component development system, in which the developing roller contacts the photoreceptor and the cleaning process is omitted, a non-magnetic mono-component toner resistant to changes in the environment and capable of solving the low temperature double image problem is necessary.

SUMMARY OF THE INVENTION

It is an aspect of the present invention to provide a non-magnetic mono-component toner composition having good fluidity such that it can make toner be supplied smoothly, reduce PCR contamination and image quality deterioration, and enable uniform toner layer to form on the developing roller while preventing blocking at the blade of the developing roller, as well as solve the low temperature double image problem, at the non-imaging region at a low temperature.

DETAILED DESCRIPTION OF THE INVENTION

In the following detailed description, embodiments of the invention have been shown and described, simply by way of illustration of the best mode contemplated by the inventors of carrying out the invention. As will be realized, the invention may be modified in various respects, all without departing from the invention. Accordingly, the description is to be regarded as illustrative in nature, and not restrictive.

To attain the aspect, the present invention provides a non-magnetic mono-component toner composition comprising:

a) a toner mother particle comprising a binder resin, a colorant, and a charge control agent;

b) 0.05-2.5 parts by weight, preferably 0.1-2.0 parts by weight, of a spherical organic fine particle having a weight-average molecular weight ($M_w$) of 250,000-1,600,000 and an average particle size of 50-500 nm, preferably 100-300 nm, per 100 parts by weight of the toner mother particle;

c) 0.5-1.5 parts by weight of a hydrophobic silica having a specific surface area of 20-80 $m^2/g$, preferably 30-50 $m^2/g$, per 100 parts by weight of the toner mother particle; and d) 0.3-2.5 parts by weight, preferably 0.5-2.0 parts by weight, of a metal oxide fine particle having an average particle size of 50-500 nm, preferably 60-300 nm, per 100 parts by weight of the toner mother particle.

More specifically, the non-magnetic mono-component toner composition comprises:

a) 100 parts by weight of a toner mother particle comprising 100 parts by weight of a binder resin, 3-20 parts by weight of a colorant, and 0.5-5 parts by weight of a charge control agent;

b) 0.05-2.5 parts by weight of a spherical organic fine particle having a weight-average molecular weight ($M_w$) of 250,000-1,600,000 and an average particle size of 50-500 nm;

c) 0.5-1.5 parts by weight of hydrophobic silica having a specific surface area of 20-80 $m^2/g$; and d) 0.3-2.5 parts by weight of a metal oxide fine particle having an average particle size of 50-500 nm.

The present invention also provides a method of preparing the non-magnetic mono-component toner comprising the steps of:

mixing, kneading, crushing, and classifying a binder resin, a colorant, and a charge control agent to prepare a toner mother particle (step 1); and mixing the toner mother particle with i) a spherical organic fine particle having a weight-average molecular weight ($M_w$) of 250,000-1,600,000 and an average particle size of 50-500 nm, ii) a hydrophobic silica having a specific surface area of 20-80 $m^2/g$, and iii) a metal oxide fine particle having an average particle size of 50-500 nm, using a stirrer (step 2).

More specifically, the preparing method comprises the steps of:

mixing, kneading, crushing, and classifying 100 parts by weight of a binder resin, 3-20 parts by weight of a colorant, and 0.5-5 parts by weight of a charge control agent to prepare a toner mother particle (step 1); and mixing 100 parts by weight of the toner mother particle with i) a spherical organic fine particle having a weight-average molecular weight ($M_w$) of 250,000-1,600,000 and an average particle size of 50-500 nm, ii) 0.5-1.5 parts by weight of a hydrophobic silica having a specific surface area of 20-80 $m^2/g$, and iii) 0.3-2.5 parts by weight of a metal oxide fine particle having an average particle size of 50-500 nm, using a stirrer (step 2).

The toner mother particle has an average particle size of 5-25 μm, although it is not limited to this range, and can be prepared by melt kneading, crushing, polymerization, etc. The toner mother particle may further comprise a release agent to prevent offset of the particle.

The present inventors worked for a non-magnetic mono-component toner composition enabling contact of the developing roller with the photoreceptor, that is resistant to changes of the environment in non-magnetic mono-component development system, in which the cleaning process is omitted, and that is capable of solving the low temperature double image problem. In doing so, they found that a non-magnetic mono-component toner composition comprising a spherical organic particle having a weight-average molecular weight ($M_w$) of 250,000-1,600,000 and an average particle size of 50-500 nm, a hydrophobic silica, and a metal oxide fine particle on the surface of a toner mother particle comprising a binder resin, a colorant, and a charge control agent ensures smooth toner supply because of good fluidity, reduces PCR contamination and deterioration of image quality, enables uniform toner layer formation on the development roller, and prevents blocking at the blade of the developing roller, while solving the low temperature double image problem, at the non-imaging region at a low temperature.

Hereunder is given a detailed description of the present invention.

The binder resin may be any coating resin. Specifically, the binder resin may be obtained from polymerization of an alcohol and a carboxylic acid.

The alcohol may be a secondary or higher alcohol, such as ethylene glycol, diethylene glycol, triethylene glycol, polyethylene glycol, propylene glycol, butanediol, pentanediol, hexanediol, cyclohexanedimethanol, xylene glycol, bisphenol A, bisphenol A ethylene oxide, bisphenol A propylene oxide, sorbitol, and glycerine, an alcohol derivative, or a mixture thereof. The carboxylic acid may be a secondary or higher carboxylic acid, such as maleic acid, fumaric acid, phthalic acid, isophthalic acid, terephthalic acid, succinic acid, adipic acid, trimeritic acid, cyclopentanedicarboxylic acid, succinic acid anhydride, trimeritic acid anhydride, and maleic acid anhydride, a carboxylic acid derivative, a carboxylic acid anhydride, or a mixture thereof.

Examples of the binder resin are an acrylic acid ester polymer such as polyester, poly(methyl acrylate), poly(ethyl acrylate), poly(butyl acrylate), poly(2-ethylhexyl acrylate), and poly(lauryl acrylate); a methacrylic acid ester polymer such as poly(methyl methacrylate), poly(butyl methacrylate), poly(hexyl methacrylate), poly(2-ethylhexyl methacrylate), and poly(lauryl methacrylate); a copolymer of acrylic acid ester and methacrylic acid ester; a copolymer of a styrene monomer and acrylic acid ester or methacrylic acid ester; an ethylene polymer such as poly(vinyl acetate), poly(vinyl propionate), poly(vinyl lactate), polyethylene, and polypropylene, and copolymers thereof; a styrene copolymer such as a styrene-butadiene copolymer, a styrene-isoprene copolymer, and a styrene-maleic acid copolymer; poly(vinyl ether); poly(vinyl ketone); polyester; polyamide; polyurethane; a rubber; an epoxy resin; a poly(vinyl butyral) resin; a modified resin; a phenol resin; and a mixture thereof. Among them, polyester is particularly preferable.

The content of the colorant should be sufficient so that a sufficiently visible image can be obtained. Preferably, it is comprised at 3-20 parts by weight per 100 parts by weight of the binder resin.

Carbon black is preferred as the black colorant, and yellow, magenta, and cyan colorants are preferred as the colored colorants.

For the yellow colorant, a condensed nitrogen compound, an isoindolinone compound, an anthracene compound, an azo metal complex, an allyl amide compound, etc., may be used. To be specific, C.I. pigments yellow 12, 13, 14, 15, 17, 62, 74, 83, 93, 94, 95, 109, 110, 111, 128, 129, 147, 168, etc., are preferable.

For the magenta colorant, a condensed nitrogen compound, anthracene, a quinacridone compound, a basic dye lake compound, a naphthol compound, a benzoimidazole compound, a thioindigo compound, a perylene compound, etc., may be used. To be specific, C.I. pigments red 2, 3, 5, 6, 7, 23, 48:2, 48:3, 48:4, 57:1, 81:1, 144, 146, 166, 169, 177, 184, 185, 202, 206, 220, 221, 254, etc., are particularly preferable.

For the cyan colorant, a copper phthalocyanin compound and its derivative, an anthracene compound, a basic dye lake compound, etc., may be used. To be specific, C.I. pigments blue 1, 7, 15, 15:1, 15:2, 15:3, 15:4, 60, 62, 66, etc., are particularly preferable.

The colorant may be used alone or in combination. It may also be used in the solid solution state. The colorant is selected considering color tone, chroma, brightness, weather resistance, OHP transparency, dispersibility, etc., of the toner.

The charge control agent may be a metal-containing azo dye, a salicylic acid compound, etc., for negative charging, and a nigrosine dye, a quaternary ammonium salt, etc., for positive charging. Although not particularly limited, the charge control agent is comprised at 0.5-5 parts by weight per 100 parts by weight of the binder resin.

In the case where only hydrophobic silica is used in a non-magnetic mono-component toner, fluidity is improved significantly, but the toner may experience blocking after long use and there is little improvement in PCR contamination. Thus, a spherical organic fine particle having a weight-average molecular weight ($M_w$) of 250,000-1,600,000 and an average particle size of 50-500 nm is added along with hydrophobic silica.

When the spherical organic fine particle is used along with silica, as in the present invention, charging behavior of the toner is affected by the spherical organic particle present on the surface of the toner particle and the silica surrounding the organic particle. And, frictional resistance applied to the toner during charging between the sleeve and the charging blade is reduced, so that melting or solid adhesion of the toner on the charging blade can be prevented. Therefore, a stable image can be obtained for a long time.

In this description, the term "spherical" means that the R (average of circularity) value calculated by the following equation is at least 0.92:

$$R=L_0/L_1 \quad (1)$$

where $L_1$ is the perimeter of the projected image of the organic fine particle in nm and $L_0$ is the perimeter of the circle having the same area as the projected area of the organic fine particle in nm.

Thus, when R=1.0, a perfect circle is obtained. This case may be called perfectly spherical.

The spherical organic fine particle preferably has a weight-average molecular weight ($M_w$) of 250,000-1,600,000 and an average particle size of 50-500 nm, more preferably 100-300 nm. If the weight-average molecular weight is below 250,000, the particle may melt and adhere to the fusing roller, thereby causing contamination. On the other hand, if it is larger than 1,600,000, frictional charging of the toner is interrupted, which causes background contamination and deterioration of uneven image. Also, if the average particle size is below 50 nm, there are insufficient organic fine particles on the surface of the toner mother particles, so that toner blocking occurs at a low temperature. On the other hand, if it exceeds 500 nm, the organic fine particles may be separated from the surface of the toner mother particles, which makes fusing property of the toner particles incomplete.

The spherical organic fine particle is preferably comprised at 0.05-2.5 parts by weight, more preferably at 0.1-2.0 parts by weight, per 100 parts by weight of the toner mother particle. If the content falls short of 0.05 parts by weight, the advantageous effect is only slight. On the other hand, if it exceeds 2.5 parts by weight, excessive spherical organic fine particles may cause PCR contamination, drum contamination, and reduction in transfer efficiency.

The spherical organic fine particle has a polymer structure and may be prepared from the following monomers, such as: a styrene like styrene, methylstyrene, dimethylstyrene, ethylstyrene, phenylstyrene, chlorostyrene, hexylstyrene, octylstyrene, and nonylstyrene; vinyl halides like vinyl chloride and vinyl fluoride; vinyl esters like vinyl acetate and vinyl benzoate; methacrylates like methyl methacrylate, ethyl methacrylate, propyl methacrylate, n-butyl methacrylate, isobutyl methacrylate, 2-ethylhexyl methacrylate, and phenyl acrylate; acrylic acid derivatives like acrylonitrile and methacrylonitrile; acryaltes like methyl acrylate, ethyl acrylate, butyl acrylate, and phenyl acrylate; tetrafluoroethylene; and 1,1-difluoroethylene, which may be used alone or in combination. The monomer may be used in an admixture with a styrene resin, an epoxy resin, a polyester resin, or a polyurethane resin.

The hydrophobic silica has a specific surface area of 20-80 $m^2/g$, preferably 30-50 $m^2/g$. It prevents the toner from blocking the blade. If the silica has a specific surface area smaller than 20 $m^2/g$ the toner may block the blade and a stripped pattern may occur in the printed image. Otherwise, if the specific surface area exceeds 80 $m^2/g$ the hydrophobic silica may be embedded in the surface of the toner particle, thereby causing blocking of the toner at the blade and impairing durability. The hydrophobic silica prevents blocking of the toner at the blade only when it is used along with the spherical organic fine particle.

Here, the specific surface area of the hydrophobic silica means the value measured according to the BET method. The specific surface area may be measured using, for example, the commercially available high-precision automatic gas adsorption apparatus. Inert gas, particularly nitrogen gas, is used as an adsorption gas to determine the amount of gas adsorption required to form a single molecular layer on the surface of the hydrophobic silica particle.

The BET specific surface area (S, $m^2/g$ ) is determined from the measurement.

Preferably, the hydrophobic silica is attached on the surface of the toner particle at 0.5-1.5 parts by weight per 100 parts by weight of the toner mother particle. If the attachment amount of the silica is below 0.5 parts by weight, the toner becomes less fluid, it causes PCR contamination, uneven image, and toner blocking at the blade. On the other hand, if it exceeds 1.5 parts by weight, excess silica reduces the fusing property.

A silane coupling agent, a silicone oil, etc., may be applied on, or attached to, the silica particle to make it hydrophobic.

For the silane coupling agent, dimethyldichlorosilane, trimethylchlorosilane, methyltrichlorosilane, arylphenyldichlorosilane, benzyldimethylchlorosilane, bromomethyldimethylchlorosilane, p-chlorophenyltrichlorosilane, 3-chloropropyltrimethoxysilane, vinyltriethoxysilane, vinyltriacetoxysilane, divinylchlorosilane, hexamethylene disilazene, etc., may be used.

For the silicone oil, one having a viscosity at 25° C. of 50-10,000 cps (centipoises), such as dimethylsilicone oil, methylphenylsilicone oil, methylhydrogen silicone oil, alkyl-modified silicone oil, fluorine-modified silicone oil, alcohol-modified silicone oil, amino-modified silicone oil, epoxy-modified silicone oil, epoxy polyethylene-modified silicone oil, phenol-modified silicone oil, carboxyl-modified silicone oil, and mercapto-modified silicone oil, may be used.

The hydrophobic treatment using the silicone oil is not particularly limited, as long as the silicone oil is attached on the surface of the inorganic particle. For example, silica is mixed in a mixing tank, added by spray of silicone oil diluted with a solvent, heated, and dried in the mixing tank while stirring.

The hydrophobic silica is attached to the toner particle using a stirrer such as a turbine type stirrer, a Henschel mixer, or a super mixer, or by using a surface modifying apparatus ("Nara Hybridization System", Nara Machinery Co., Ltd.). The hydrophobic silica may be loosely attached to the toner particle or part of it may be embedded in the surface of the toner particle.

The metal oxide fine particle has an average particle size of 50-500 nm, preferably 60-300 nm. If the average particle size of the metal oxide fine particle is smaller than 50 nm or larger than 500 nm, improvement in fluidity and PCR contamination is insufficient. The metal oxide fine particle improves fluidity and PCR contamination only when used along with the spherical organic fine particle and the hydrophobic silica.

For the metal oxide fine particle, titanium dioxide, aluminum oxide, zinc oxide, magnesium oxide, cerium oxide, iron oxide, copper oxide, tin oxide, etc., may be used. Considering the degree of modification and availability, titanium dioxide is preferable.

The metal oxide fine particle is preferably attached to the toner mother particle at 0.3-2.5 parts by weight, more preferably at 0.5-2 parts by weight, per 100 parts by weight of the toner mother particle. If the attachment amount is below 0.3 parts by weight, PCR contamination is not improved. On the other hand, if it exceeds 2.5 parts by weight, the fusing property worsens.

For the release agent, one having a small molecular weight, such as polyethylene wax, polypropylene wax, and an olefin resin having a small molecular weight, may be used. Besides, a fatty acid metal salt may be used. For the olefin resin having a small molecular weight, polypropylene, polyethylene, a propylene-ethylene copolymer, etc., may be used. For the fatty acid, a natural fatty acid or a synthetic fatty acid having 4-40 carbon atoms, which may be saturated or unsaturated and may have a hydroxyl, aldehyde, or epoxy group, may be used. For example, For example, caproic acid, caprylic acid, capric acid, lauric acid, myristic acid, myristate oleic acid palmitic acid, palmitoleic acid, stearic acid, oleic acid, linoleic acid, arachic acid, behenic acid, erucic acid, montanic acid, isostearic acid, epoxystearic acid, etc., may be used. The release agent is preferably comprised at 0.05-5 parts by weight per 100 parts by weight of the binder resin. In particular, polypropylene is preferable.

Hereinafter, the present invention is described in more detail through examples. However, the following examples are only for the understanding of the present invention and they do not limit the present invention.

EXAMPLES

Example 1

1) Preparation of Toner Mother Particle

The constituents presented in Table 1 below were mixed with a Henschel mixer. The mixture was melted and kneaded at 155 □ in a twin extruder, crushed with a jet mill crusher, and classified with an air classifier to obtain a toner mother particle having a volume-average particle size of 8.9 μm.

TABLE 1

| Category | Constituents | Mixing proportion (parts by weight) |
|---|---|---|
| Binder resin | Polyester resin | 100 |
| Colorant | Carbon black | 10 |
| Charge control agent | Metal-containing azo salt | 3 |
| Release agent | Polypropylene having low molecular weight | 3 |

2) Preparation of Non-Magnetic Mono-Component Toner Composition 0.1 parts by weight of polystyrene-n-butyl methacrylate (PS/BMA) having a weight-average molecular weight ($M_w$) of 250,000 and an average particle size of 50 nm as an organic fine particle, 0.5 parts by weight of hydrophobic silica having a specific surface area of 60 $m^2/g$ as hydrophobic silica, and 1.0 part by weight of titanium oxide having an average particle size of 100 nm as metal oxide fine particles, per 100 parts by weight of the prepared toner mother particle, were mixed and stirred for 5 minutes along with the toner mother particle using a Henschel mixer to obtain a non-magnetic mono-component toner.

Examples 2-88

Comparative Examples 1-20

Non-magnetic mono-component toner compositions were prepared in the same manner of Example 1, except that the contents of polystyrene-n-butyl methacrylate organic fine particles, hydrophobic silica, and metal oxide fine particles were changed as presented in Table 2, Table 3, and Table 4 below.

TABLE 2

| Category | Weight-average molecular weight ($M_w$, 10,000) | Average particle size (nm) |
|---|---|---|
| PS/BMA A | 25 | 50 |
| PS/BMA B | 25 | 200 |
| PS/BMA C | 25 | 500 |
| PS/BMA D | 80 | 50 |
| PS/BMA E | 80 | 200 |
| PS/BMA F | 80 | 500 |
| PS/BMA G | 160 | 50 |
| PS/BMA H | 160 | 200 |
| PS/BMA I | 160 | 500 |
| PS/BMA J | 15 | 200 |
| PS/BMA K | 200 | 200 |
| PS/BMA L | 80 | 40 |
| PS/BMA M | 80 | 600 |

TABLE 3

| Example No. | Organic fine particle (parts by weight) | Hydrophobic silica (parts by weight) | Titanium oxide (parts by weight) |
|---|---|---|---|
| 2 | PS/BMA A, 0.05 | 0.5 | 1.0 |
| 3 | PS/BMA A, 1.5 | 0.5 | 1.0 |
| 4 | PS/BMA A, 2.5 | 0.5 | 1.0 |
| 5 | PS/BMA A, 0.05 | 1.0 | 1.0 |
| 6 | PS/BMA A, 1.5 | 1.0 | 1.0 |
| 7 | PS/BMA A, 2.5 | 1.0 | 1.0 |
| 8 | PS/BMA A, 0.05 | 1.5 | 1.0 |
| 9 | PS/BMA A, 1.5 | 1.5 | 1.0 |
| 10 | PS/BMA A, 2.5 | 1.5 | 1.0 |
| 11 | PS/BMA B, 0.05 | 0.5 | 1.0 |
| 12 | PS/BMA B, 1.5 | 0.5 | 1.0 |
| 13 | PS/BMA B, 2.5 | 0.5 | 1.0 |
| 14 | PS/BMA B, 0.05 | 1.0 | 1.0 |
| 15 | PS/BMA B, 1.5 | 1.0 | 1.0 |
| 16 | PS/BMA B, 2.5 | 1.0 | 1.0 |
| 17 | PS/BMA B, 0.05 | 1.5 | 1.0 |
| 18 | PS/BMA B, 1.5 | 1.5 | 1.0 |
| 19 | PS/BMA B, 2.5 | 1.5 | 1.0 |
| 20 | PS/BMA C, 0.05 | 0.5 | 1.0 |
| 21 | PS/BMA C, 1.5 | 0.5 | 1.0 |
| 22 | PS/BMA C, 2.5 | 0.5 | 1.0 |
| 23 | PS/BMA C, 0.05 | 1.0 | 1.0 |
| 24 | PS/BMA C, 1.5 | 1.0 | 1.0 |
| 25 | PS/BMA C, 2.5 | 1.0 | 1.0 |
| 26 | PS/BMA C, 0.05 | 1.5 | 1.0 |
| 27 | PS/BMA C, 1.5 | 1.5 | 1.0 |
| 28 | PS/BMA C, 2.5 | 1.5 | 1.0 |
| 29 | PS/BMA D, 0.05 | 0.5 | 1.0 |
| 30 | PS/BMA D, 1.5 | 0.5 | 1.0 |
| 31 | PS/BMA D, 2.5 | 0.5 | 1.0 |
| 32 | PS/BMA D, 0.05 | 1.0 | 1.0 |
| 33 | PS/BMA D, 1.5 | 1.0 | 1.0 |
| 34 | PS/BMA D, 2.5 | 1.0 | 1.0 |
| 35 | PS/BMA D, 0.05 | 1.5 | 1.0 |
| 36 | PS/BMA D, 1.5 | 1.5 | 1.0 |
| 37 | PS/BMA D, 2.5 | 1.5 | 1.0 |
| 38 | PS/BMA E, 0.05 | 0.5 | 1.0 |
| 39 | PS/BMA E, 1.5 | 0.5 | 1.0 |
| 40 | PS/BMA E, 2.5 | 0.5 | 1.0 |
| 41 | PS/BMA E, 0.05 | 1.0 | 1.0 |
| 42 | PS/BMA E, 1.5 | 1.0 | 1.0 |
| 43 | PS/BMA E, 2.5 | 1.0 | 1.0 |
| 44 | PS/BMA E, 0.0.5 | 1.5 | 1.0 |
| 45 | PS/BMA E, 1.5 | 1.5 | 1.0 |
| 46 | PS/BMA E, 2.5 | 1.5 | 1.0 |
| 47 | PS/BMA F, 0.05 | 0.5 | 1.0 |
| 48 | PS/BMA F, 1.5 | 0.5 | 1.0 |
| 49 | PS/BMA F, 2.5 | 0.5 | 1.0 |
| 50 | PS/BMA F, 0.0.5 | 1.0 | 1.0 |
| 51 | PS/BMA F, 1.5 | 1.0 | 1.0 |
| 52 | PS/BMA F, 2.5 | 1.0 | 1.0 |
| 53 | PS/BMA F, 0.05 | 1.5 | 1.0 |

TABLE 3-continued

| Example No. | Organic fine particle (parts by weight) | Hydrophobic silica (parts by weight) | Titanium oxide (parts by weight) |
|---|---|---|---|
| 54 | PS/BMA F, 1.5 | 1.5 | 1.0 |
| 55 | PS/BMA F, 2.5 | 1.5 | 1.0 |
| 56 | PS/BMA G, 0.05 | 0.5 | 1.0 |
| 57 | PS/BMA G, 1.5 | 0.5 | 1.0 |
| 58 | PS/BMA G, 2.5 | 0.5 | 1.0 |
| 59 | PS/BMA G, 0.05 | 1.0 | 1.0 |
| 60 | PS/BMA G, 1.5 | 1.0 | 1.0 |
| 61 | PS/BMA G, 2.5 | 1.0 | 1.0 |
| 62 | PS/BMA G, 0.05 | 1.5 | 1.0 |
| 63 | PS/BMA G, 1.5 | 1.5 | 1.0 |
| 64 | PS/BMA G, 2.5 | 1.5 | 1.0 |
| 65 | PS/BMA H, 0.05 | 0.5 | 1.0 |
| 66 | PS/BMA H, 1.5 | 0.5 | 1.0 |
| 67 | PS/BMA H, 2.5 | 0.5 | 1.0 |
| 68 | PS/BMA H, 0.05 | 1.0 | 1.0 |
| 69 | PS/BMA H, 1.5 | 1.0 | 1.0 |
| 70 | PS/BMA H, 2.5 | 1.0 | 1.0 |
| 71 | PS/BMA H, 0.05 | 1.5 | 1.0 |
| 72 | PS/BMA H, 1.5 | 1.5 | 1.0 |
| 73 | PS/BMA H, 2.5 | 1.5 | 1.0 |
| 74 | PS/BMA I, 0.05 | 0.5 | 1.0 |
| 75 | PS/BMA I, 1.5 | 0.5 | 1.0 |
| 76 | PS/BMA I, 2.5 | 1.0 | 1.0 |
| 77 | PS/BMA I, 0.05 | 1.0 | 1.0 |
| 78 | PS/BMA I, 1.5 | 1.0 | 1.0 |
| 79 | PS/BMA I, 2.5 | 1.5 | 1.0 |
| 80 | PS/BMA I, 0.05 | 1.5 | 1.0 |
| 81 | PS/BMA I, 1.5 | 1.5 | 1.0 |
| 82 | PS/BMA I, 2.5 | 1.5 | 1.0 |
| 83 | PS/BMA E, 1.5 | 0.5 | 0.3 |
| 84 | PS/BMA E, 1.5 | 0.5 | 2.5 |
| 85 | PS/BMA E, 1.5 | 1.0 | 0.3 |
| 86 | PS/BMA E, 1.5 | 1.0 | 2.5 |
| 87 | PS/BMA E, 1.5 | 1.5 | 0.3 |
| 88 | PS/BMA E, 1.5 | 1.5 | 2.5 |

TABLE 4

| Comparative Example No. | Organic fine particle (parts by weight) | Hydrophobic silica (parts by weight) | Titanium oxide (parts by weight) |
|---|---|---|---|
| 1 | PS/BMA E, 1.5 | 1.0 | 0.2 |
| 2 | PS/BMA E, 1.5 | 1.0 | 2.6 |
| 3 | PS/BMA E, 1.5 | 0.4 | 1.0 |
| 4 | PS/BMA E, 1.5 | 1.6 | 1.0 |
| 5 | — | 1.0 | 1.0 |
| 6 | — | 1.0 | 1.0 |
| 7 | PS/BMA E, 1.5 | — | 1.0 |
| 8 | PS/BMA E, 1.5 | — | 1.0 |
| 9 | PS/BMA E, 1.5 | 1.0 | — |
| 10 | PS/BMA E, 1.5 | 1.0 | — |
| 11 | PS/BMA E, 0.03 | 0.5 | 1.0 |
| 12 | PS/BMA E, 3.0 | 0.5 | 1.0 |
| 13 | PS/BMA E, 0.03 | 1.0 | 1.0 |
| 14 | PS/BMA E, 3.0 | 1.0 | 1.0 |
| 15 | PS/BMA E, 0.03 | 1.5 | 1.0 |
| 16 | PS/BMA E, 3.0 | 1.5 | 1.0 |
| 17 | PS/BMA J 1.5 | 0.5 | 1.0 |
| 18 | PS/BMA K 1.5 | 0.5 | 1.0 |
| 19 | PS/BMA L 1.5 | 0.5 | 1.0 |
| 20 | PS/BMA M 1.5 | 0.5 | 1.0 |

Example 89

A non-magnetic mono-component toner was prepared in the same manner of Example 1, except that 1.5 parts by weight of a poly (methyl methacrylate) organic fine particle (PMMA powder) having a particle size of 0.1 μm and a weight-average molecular weight ($M_w$) of 1,000,000 was used instead of the PS/BMA.

Comparative Example 21

A non-magnetic mono-component toner was prepared in the same manner of Example 89, except that 1.5 parts by weight of a non-spherical (R=0.54) organic fine particle (St/BA/MMA powder) comprising styrene-butyl acrylate-methacrylate, which has a particle size of 0.15 μm and a weight-average molecular weight ($M_w$) of 600,000, was used instead of the spherical PS/BMA.

Testing Example 1

The non-magnetic mono-component toner compositions prepared in Examples 1-89 and Comparative Examples 1-21 were applied to a contact type of non-magnetic mono-component development printer (ML5300, Samsung Electronics) at a temperature of 5° C. and relative humidity of 20% to print 5,000 sheets of paper. The printing is perfromed in a normal temperature and humidity (20° C., 55% RH). Properties of the toner were tested as follows.

1. Low Temperature Double Imaging

After printing a pattern on a predetermined number of sheets of normal paper at low temperature and humidity (5° C., 20% RH), it was observed with the naked eye if there was any printed image in the non-imaging region.

No low temperature double imaging (superior): No pattern printed in the non-imaging region.

Low temperature double imaging (poor): Pattern printed in the non-imaging region.

2. Toner blocking

After printing a predetermined number of sheets of paper, a full (solid) black color was printed. It was observed if there was any stripped pattern on the printed image, which is caused by blocking of the toner at the development blade.

No toner blocking (superior): No stripped pattern.

Toner blocking (poor): Stripped pattern observed on the solid image.

3. Fusing Property

After printing a predetermined number of sheets of paper, a pattern was printed to see if the same pattern was printed on the non-imaging region because of imperfect fusing.

No fusing imperfection (superior): No printing in the non-imaging region.

Fusing imperfection (poor): Printing in the non-imaging region.

The non-magnetic mono-component toner compositions prepared in Examples 1-89 showed no low temperature double imaging, toner blocking, or fusing problem.

Test results for Comparative Examples 1-21 are presented in Table 5 below.

TABLE 5

| Category | Low temperature double imaging | Toner blocking | Fusing imperfection |
|---|---|---|---|
| Comparative Example 1 | None | Observed | None |
| Comparative Example 2 | None | None | Poor |
| Comparative Example 3 | Observed | None | Poor |
| Comparative Example 4 | Observed | Observed | None |

TABLE 5-continued

| Category | Low temperature double imaging | Toner blocking | Fusing imperfection |
|---|---|---|---|
| Comparative Example 5 | None | Observed | None |
| Comparative Example 6 | Observed | Observed | None |
| Comparative Example 7 | None | Observed | None |
| Comparative Example 8 | None | None | Poor |
| Comparative Example 9 | Observed | None | None |
| Comparative Example 10 | None | Observed | None |
| Comparative Example 11 | Observed | None | Poor |
| Comparative Example 12 | None | Observed | None |
| Comparative Example 13 | Observed | None | Poor |
| Comparative Example 14 | Observed | None | None |
| Comparative Example 15 | None | Observed | Poor |
| Comparative Example 16 | Observed | Observed | None |
| Comparative Example 17 | Observed | Observed | None |
| Comparative Example 18 | None | None | Poor |
| Comparative Example 19 | Observed | Observed | None |
| Comparative Example 20 | None | None | Poor |
| Comparative Example 21 | Observed | Observed | None |

Accordingly, it was confirmed that the non-magnetic mono-component toner compositions of the present invention (Examples 1-89) are superior in low temperature double imaging, toner blocking, and fusing property compared with those of Comparative Examples 1-21. In Comparative Example 21, toner blocking at the blade was identified, different from when a spherical organic fine particle was used. Also, an increase in PCR contamination was identified.

As is apparent from the above description, the non-magnetic mono-component toner of the present invention ensures smooth toner supply in non-magnetic mono-component development in which the developing roller contacts the photoreceptor, because of good fluidity, and it reduces PCR contamination and deterioration of image quality, enables uniform toner layer formation on the development roller, prevents blocking at the blade of the development roller, and improves the low temperature double image problem in the non-imaging region at a low temperature. Therefore, it can be useful for an image printing device adopting non-magnetic mono-component development system in which the developing roller contacts the photoreceptor.

What is claimed is:

1. A non-magnetic mono-component toner composition comprising a) 100 parts by weight of toner mother particles comprising a binder resin, a colorant, and a charge control agent;

b) 0.05-2.5 parts by weight of spherical organic fine particles having a weight-average molecular weight ($M_w$) of 250,000-1,600,000 and an average particle size of 50-500 nm;

c) 0.5-1.5 parts by weight of hydrophobic silica having a specific surface area of 20-80 $m^2/g$; and d) 0.3-2.5 parts by weight of metal oxide fine particles having an average particle size of 50-500 nm.

2. The non-magnetic mono-component toner composition of claim 1, wherein the toner mother particles comprise 100 parts by weight of a binder resin, 3-20 parts by weight of a colorant, and 0.5-5 parts by weight of a charge control agent.

3. The non-magnetic mono-component toner composition of claim 1 or claim 2, wherein a) the toner mother particle further comprises 0.05-5 parts by weight of a release agent.

4. The non-magnetic mono-component toner composition of claim 1 or claim 2, wherein b) the spherical organic fine particle is a polymer prepared from a monomer selected from the group consisting of: a styrene such as styrene, methylstyrene, dimethyistyrene, ethylstyrene, phenylstyrene, chiorostyrene, hexyistyrene, octylstyrene, and nonylstyrene; a vinyl halide such as vinyl chloride and vinyl fluoride; a vinyl ester such as vinyl acetate and vinyl benzoate; a methacrylate such as methyl methacrylate, ethyl methacrylate, propyl methacrylate, n-butyl methacrylate, isobutyl methacrylate, 2-ethyihexyl methacrylate, and phenyl acrylate; an acrylic acid derivative such as acrylonitrile, and methacrylonitrile; an acrylate such as methyl acrylate, ethyl acrylate, butyl acrylate, and phenyl acrylate; tetrafluoroethylene; 1,1-difluoroethylene; and a mixture thereof.

5. The non-magnetic mono-component toner composition of claim 1 or claim 2, wherein c) the hydrophobic silica is hydrophobicated with a silane coupler or silicone oil.

6. The non-magnetic mono-component toner composition of claim 5, wherein the silicone oil has a viscosity of 50-10,000 cps at 25° C.

7. The non-magnetic mono-component toner composition of claim 1 or claim 2, wherein d) the metal oxide fine particle is at least one selected from the group consisting of titanium dioxide, aluminum oxide, zinc oxide, magnesium oxide, cerium oxide, iron oxide, copper oxide, and tin oxide.

8. The non-magnetic mono-component toner composition of claim 1, wherein the spherical organic fine particles have a weight-average molecular weight ($M_w$) of 800,000-1,600,000.

9. The non-magnetic mono-component toner composition of claim 1, wherein the spherical organic fine particles have an average particle size of 100-300 nm.

10. The non-magnetic mono-component toner composition of claim 1, wherein the spherical organic fine particles have an average circularity value R of at least 0.92, which is calculated by the following equation:

$$R=L_0/L_1 \quad (1)$$

where $L_1$ is the perimeter of the projected image of the organic fine particles and $L_0$ is the perimeter of the circle having the same area as the projected area of the organic fine particles.

11. A method of preparing a non-magnetic mono-component toner comprising the steps of mixing, kneading, crushing, and classifying a binder resin, a colorant, and a charge control agent to prepare a toner mother particle (step 1 ); and mixing 100 parts by weight of the toner mother particle with i) 0.05-2.5 parts by weight of spherical organic fine particles having a weight-average molecular weight ($M_w$) of 250,000-1,600,000 and an average particle size of 50-500 nm, ii) 0.5-1.5 parts by weight of hydrophobic silica having a specific surface area of 20-80 $m^2/g$, and iii) 0.3 -2.5 parts by weight of metal oxide fine particles having an average particle size of 50 -500 nm using a stirrer (step 2).

12. The method of claim 11, whieh wherein step 1 comprises mixing, kneading, crushing, and classifying 100 parts by weight of a binder resin, 3-20 parts by weight of a colorant, and 0.5-5 parts by weight of a charge control agent to prepare a the toner mother particle (step 1).

13. The method of claim 11 or claim 12, wherein the mixing is performed using a Hensehel mixer, the kneading is performed using a twin extruder, the crushing is performed using a jet mill crusher, and the classifying is performed using an air classifier, in the step 1.

14. The method of claim 11 or claim 12, wherein 0.05-5 parts by weight of a release agent is further added to the toner mother particle, in the step 1.

15. The method of claim 11 or claim 12, wherein the spherical organic fine particle of step 2 is a polymer prepared from a monomer selected from the group consisting of: a styrene such as styrene, methylstyrene, dimethylstyrene, ethylstyrene, phenylstyrene, chlorostyrene, hexylstyrene, octylstyrene, and nonylstyrene; a vinyl halide such as vinyl chloride and vinyl fluoride; a vinyl ester such as vinyl acetate and vinyl benzoate; a methacrylate such as methyl methacrylate, ethyl methacrylate, propyl methacrylate, n-butyl methacrylate, isobutyl methacrylate, 2-ethylhexyl methacrylate, and phenyl acrylate; an acrylic acid derivative such as acrylonitrile and methacrylonitrile; an acrylate such as methyl acrylate, ethyl acrylate, butyl acrylate, and phenyl acrylate; tetrafluoroethylene; 1,1-difluoroethylene; and a mixture thereof.

16. The method of claim 11 or claim 12, wherein the hydrophobic silica of step 2 is hydrophobicated with a silane coupler or silicone oil.

17. The method of claim 16, wherein the silicone oil has a viscosity of 50-10,000 cps at 25° C.

18. The method of claim 11 or claim 12, wherein the metal oxide fine particles of step 2 comprise at least one metal oxide selected from the group consisting of titanium dioxide, aluminum oxide, zinc oxide, magnesium oxide, cerium oxide, iron oxide, copper oxide, and tin oxide.

* * * * *